United States Patent [19]

Dinkha et al.

[11] Patent Number: 4,939,996

[45] **Date of Patent: * Jul. 10, 1990**

[54] CERAMIC MUNITIONS PROJECTILE

[75] Inventors: Brian I. Dinkha, Westminster; Paul B. Jasa, Denver; Brian Seegmiller, Arvada; Alden C. Simmons, Boulder, all of Colo.

[73] Assignee: Coors Porcelain Company, Golden, Colo.

[ * ] Notice: The portion of the term of this patent subsequent to Jul. 25, 2006 has been disclaimed.

[21] Appl. No.: 239,131

[22] Filed: Aug. 31, 1988

Related U.S. Application Data

[63] Continuation-in-part of Ser. No. 903,307, Sep. 3, 1986, Pat. No. 4,850,278.

[51] Int. Cl.[5] ..... F42B 8/00

[52] U.S. Cl. ..... 102/501; 102/444; 102/506; 102/529; 501/103; 501/104; 501/128

[58] Field of Search ..... 102/436, 439, 444, 491, 102/498, 501, 502, 506, 517-519, 529; 501/90, 95, 103, 104, 128

[56] References Cited

U.S. PATENT DOCUMENTS

| | | | |
|---|---|---|---|
| 2,315,853 | 4/1943 | Hodgson . | |
| 2,926,612 | 3/1960 | Olin . | |
| 3,123,003 | 3/1964 | Lange, Jr. et al. . | |
| 3,232,233 | 2/1966 | Singleton . | |
| 3,276,369 | 10/1966 | Bell . | |
| 3,289,585 | 12/1966 | Rudolph et al. . | |
| 3,338,167 | 8/1967 | Jungermann et al. . | |
| 3,375,108 | 3/1968 | Linwood et al. . | |
| 3,463,047 | 8/1969 | Germershausen . | |
| 3,902,683 | 9/1975 | Bilsbury . | |
| 4,040,359 | 8/1977 | Blajda et al. . | |
| 4,067,745 | 1/1978 | Garvie et al. . | |
| 4,108,074 | 8/1978 | Billing, Jr. et al. . | |
| 4,109,579 | 8/1978 | Carter . | |
| 4,165,692 | 8/1979 | Dufort . | |
| 4,208,968 | 6/1980 | Hubsch et al. . | |
| 4,508,036 | 4/1985 | Jensen et al. . | |
| 4,527,481 | 7/1985 | Evans et al. . | |
| 4,659,680 | 4/1987 | Guile . | |
| 4,704,943 | 11/1987 | McDougal . | |
| 4,850,278 | 7/1989 | Dinkha et al. | 102/501 |

FOREIGN PATENT DOCUMENTS

| | | |
|---|---|---|
| 1154793 | 10/1983 | Canada . |
| 0013599 | 7/1980 | European Pat. Off. . |
| 8304247 | 12/1983 | PCT Int'l Appl. . |
| 538268 | 7/1941 | United Kingdom . |

OTHER PUBLICATIONS

"Mark's Standard Handbook for Mechanical Engineers", Edited by Avallone et al., Ninth Edition, McGraw-Hill, pp. 6-105.

R-Curve Behavior and The Mechanical Properties of Transformation Toughened $ZrO_2$-Containing Ceramics, R. W. Steinbrech et al., Dept. of Metallurgy and Material Science Case Western Reserve University, Cleveland, Ohio.

Evans, A. G., "Fracture Mechanics Determinations," in Fracture Mechanics of Ceramics, vol. 1, edited by R. C. Brandt, DPH Hasselman, and F. F. Lange, Plenum Press, New York, p. 17, (1974).

Weibull, W., "A Statistical Distribution Function of Wide Applicability," Journal of Applied Mechanics, vol. 18, Sep. 1951, pp. 293-297.

Drennan, J. and R. H. J. Hannink, "Effect of SrO Editions on the Grain-Boundary Micro Structure and Mechanical Properties of Magnesia-Partially-Stabilized Zirconia," Journal of the American Ceramics Society, vol. 69, No. 7, pp. 541-546.

(List continued on next page.)

*Primary Examiner*—Harold J. Tudor

*Attorney, Agent, or Firm*—Sheridan, Ross & McIntosh

[57] ABSTRACT

A ceramic munitions projectile, particularly useful for practice or target munitions is provided. The projectile has a tensile strength greater than about 250 MPa, a critical stress intensity factor greater than about 6 $MPam^{\frac{1}{2}}$, and a Weibull modulus greater than about 10. Preferably the projectile is frangible.

14 Claims, 1 Drawing Sheet

OTHER PUBLICATIONS

Hughan, Robert R. and Richard H. J. Hannink, "Precipitation During Controlled Cooling of Magnesia-Partially-Stabilized Zirconia", Journal American Ceramic Society, vol. 69, No. 7, pp. 556-563.

Hannink, R. H. J. and M. V. Swain, "Magnesia-Partially-Stabilized Zirconia: The Influence of Heat Treatment on Thermo-Mechanical Properties," Journal of Australian Ceramic Society, vol. 18, No. 2, pp. 53-62, 1982.

Swain, M. V., "Inelastic Deformation of Mg-PSZ and its Significance for Strength-Toughness Relationship of Zirconia Toughened Ceramics", Acta Metall, vol. 33, No. 11, pp. 2083-2091.

Coors/Ceramics "TTZ (Transformation Toughened Zirconia)".

Coors/Ceramics "Materials for Tough Jobs".

Magnesium Elektron, "Data Sheet 111A".

Nilsen Sintered Products, "Partially Stabilized Zirconia (PSZ)", Nilsen (USA), Inc., Glendale Heights, Ill.

Toya Soda Manufacturing Company, Ltd., "TSK Super-Z, ($ZRO_2$-$AL_2O_3$ Powder)".

Toya Soda Manufacturing Company, Ltd., "The World's Strongest".

Magnesium Elektron, "Zirconium Oxide Special Ceramic Grades," data sheet 307.

CERAMIC MUNITIONS PROJECTILE

This is a continuation-in-part application of copending U.S. patent application Ser. No. 903,307 filed on Sept. 3, 1986 now U.S. Pat. No. 4,850,278. Priority for common subject matter is also claimed from PCT Application No. PCT/US87/02176 having an international filing date of Aug. 31, 1987.

FIELD OF THE INVENTION

The present invention relates to a munitions projectile made of a ceramic material, and particularly relates to a frangible projectile useful in practice or target munitions.

BACKGROUND OF THE INVENTION

Firing ranges are typically used by persons practicing munitions firing, including military, law enforcement, sportsmen, and recreational users. When such a firing range has been used heavily or for an extended period, using live rounds of ordinary metallic bullets or projectiles, the area near the firing range can become dangerous because of the presence of large numbers of expended rounds embedded in the ground in the target area. These expended rounds can create danger by providing a hard surface from which new rounds can ricochet in an unpredictable and dangerous manner. The expended rounds can be removed by, for example, bulldozing although at a large expense, particularly when the practice range is extensive, as in the case of a military aerial practice range.

The danger from ricochets are not limited to ricochets caused by expended rounds. Projectiles such as bullets can ricochet from the ground or from a target even when the firing range is substantially free of expended rounds. For this reason,it is often desirable that practice munitions disintegrate upon striking the ground or upon striking a target.

A further difficulty with extensive use of ordinary metallic projectiles on a firing range occurs when a target is provided for practice purposes. In military or law enforcement practice, the targets often comprise expendable or dummy objects such as vehicles, tanks, buildings, etc. Extensive use of such a target eventually results in destruction of the target, requiring replacement.

Many attempts have been made to provide a projectile which is frangible, i.e. which fractures or disintegrates upon striking a target or the ground or, in some cases, upon exiting the gun muzzle. Attempts at producing a frangible or practice projectile have included projectiles composed of or including compacted metal powder (U.S. Pat. No. 3,463,047, issued Aug. 26, 1969 to Germerschausen; U.S. Pat. No. 3,338,167, issued Aug. 29, 1967 to Karlsruhe; and U.S. Pat. No. 3,123,003, issued Mar. 3, 1964 to De Jarnett, et al.), plastics or plastic composites (U.S. Pat. No. 4,108,074, issued Aug. 22, 1978 to Billing, Jr., et al.; U.S. Pat. No. 3,902,683, issued Sept. 2, 1975 to Bilsbury; U.S. Pat. No. 4,040,359, issued Aug. 9, 1977 to Blajda, et al.), epoxies or resins (U.S. Pat. No. 4,508,036, issued Apr. 2, 1985 to Jensen, et al.), and cement (U.S. Pat. No. 4,109,579, issued Aug. 29, 1978 to Carter). U.S. Pat. No. 2,926,612, issued Mar. 1, 1960 to Olin, discloses an aluminum projectile with an aluminum oxide coating about 10 microns in thickness.

None of these materials have been found satisfactory for economically producing a projectile having the ballistic characteristics necessary for realistic practice. A non-metallic projectile which closely mimics the ballistics of an ordinary metallic projectile possesses a number of characteristics. Conventional metallic projectiles are commonly made of lead, steel, iron and iron alloys. Knowing the metallic composition of a conventional projectile, a person skilled in the art is able to readily determine the total mass and center of mass for a particular size projectile. The non-metallic projectile should have a total mass and a center of mass similar to the replaced metallic projectile to mimic the flight characteristics of the metallic projectile. The surface characteristics of the non-metallic projectile must be similar to that of a metallic projectile so that the aerodynamics of the metallic projectile are mimicked. The non-metallic projectile must be sufficiently strong and tough to withstand thermal stress and mechanical stress such as the acceleration and torque forces created during firing and trajectory. The non-metallic projectile must also have sufficient wear and corrosion resistance that it is not erroded by frictive contact with dust or sand particles, rain drops, and the like and is not ablated or vaporized at the temperatures created by air friction during normal trajectory. A projectile which is erroded, ablated or vaporized will undergo a change in mass, center of mass; and/or surface characteristics and its ballistic characteristics will therefore be altered.

In addition to the dangers caused by ricochets, conventional metallic projectiles (referred to herein as "live rounds") present a number of other difficulties, whether the projectiles are to be used for target or practice uses or are to be used as ordinary munitions. Metallic munitions can contribute to environmental contamination or deterioration. Metallic projectiles such as steel, or particularly lead projectiles, can affect the environment by, e.g., leaching into the ground water or by wild life ingestion such as ingestion of shot by waterfowl.

A further problem of metallic projectiles in general is their susceptibility to corrosion. Projectiles are often stored for a substantial period of time and exposed to the ambient atmosphere which can have high levels of humidity and acidic or otherwise corrosive components. Further, munitions are often transported through particularly corrosive environments such as salt spray or fog environments, extremely hot or cold environments, and so forth. Ordinary metallic projectiles may require coating or other steps to minimize corrosion, often with only partial success.

Ceramics are among materials which are known to, in general, have good corrosion resistance. Ceramics have not, however, found use as munitions projectiles because of the difficulty of producing a ceramic which is sufficiently inexpensive that it can be used in place of traditional metallic projectiles and which is able to survive the stresses experienced during storage, transport, and loading as well as during firing and trajectory. During transport, for example, cartridges, shells, and other munitions are often subjected to rough handling of a type which causes many conventional types of ceramics to develop cracks or other flaws. These cracks or flaws may not be visibly detectible but may cause the ceramic to fail during firing or trajectory. A munitions projectile is subjected to a number of environments or phases during its firing and trajectory, each phase having different stress characteristics. Specifically, the projectile stress environment is different for the projectile firing, travel through the barrel, trajectory through the air, and impact phases. The magnitude and type of stress during each phase depends on a number of characteristics including gun characteristics (e.g. caliber, rifling, length of barrel, etc.), type of propellant (e.g. slow burn, fast burn, etc.), projectile shape (e.g. ogive shape, bourrelet shape, driving band shape, etc.), trajectory medium (low altitude versus high altitude atmosphere, water, vacuum), and target (ground, solid target, etc.).

In the firing environment, the projectile initially experiences thermal and mechanical shock loading. Detonation sends a compressive shock wave through the projectile which, when reflected, applies tensile stresses to the projectile. Rotation of the projectile also loads the projectile in tension. Thermal stresses due to temperature gradients also load the projectile intension, shear and compression. When the tensile and compressive stresses exceed the respective strengths of the projectile, cracks develop and/or grow in the projectile. When these cracks propagate to a critical size, the projectile fails. It has been found that one of the most important stress considerations is the tensile stress at muzzle velocity. Muzzle velocity depends on a number of factors including caliber, propellant type, gun type and others. For example, a 28 centimeter (11 inch) shell may have a muzzle velocity of about 3000 feet per second (about 900 meters per second). A 20 millimeter projectile may have a muzzle velocity of about 2700 feet per second (about 800 meters per second). Muzzle velocities of 4000 ft/sec (1200 m/sec) are rarely exceeded, although velocities of up to about 5300 ft/sec (1600 m/sec) can be attained using special projectile configurations such as a small projectile fitted in a larger propelling base. Lower muzzle velocities are often encountered in connection with low caliber guns. Typical shotgun projectiles may, e.g., have a muzzle velocity of about 1200 ft/sec (360 m/sec) or lower. In general, higher muzzle velocities require higher chamber pressure and result in higher projectile stress. As an example of chamber pressure, the projectile from a 50 caliber artillery shell may be propelled with a maximum chamber pressure of 2800 kg/cm$^2$ or more. As an example of magnitude of stress, a 20 millimeter projectile weighing 200 grams which reaches a velocity of 2700 feet per second, 5 milliseconds after detonation, undergoes a tensile stress of approximately 210 Megapascals (MPa). The tensile stress undergone by such a projectile upon striking a solid target can be on the order of 840 MPa or more.

Selection of a material, particularly a ceramic material suitable as a munitions projectile, however, cannot be accomplished merely by consideration of the stresses discussed above. Rather, the selection of a suitable material is complicated by a number of factors.

First, the intended use of the projectile must be considered. For example, different materials would be suitable for a projectile which must disintegrate upon exiting the muzzle as opposed to a projectile suitable for target or practice use which should survive until impact. Moreover, disintegration of ceramic materials under stress is best understood as a probabilistic phenomenon, i.e. for a given ceramic projectile material, designed to withstand a particular stress value, a certain number of projectiles of that material will disintegrate under a lower stress load, while a certain percentage will survive under significantly higher stress loads. When the desired use is, for example, target firing, the projectile material must be of such a nature that the percentage of projectiles which survive firing and trajectory stresses is high enough that there is not an unacceptable level of wasted materials or time yet the ceramic material must not have so great a strength that an unacceptable percentage of projectiles survives target impact. The level of performance which is acceptable depends, of course, on the intended application. In applications where safety of the user can be critical, such as in military or law enforcement applications, a lower failure rate would be considered acceptable as compared to applications such as hunting, sports competition, or other recreational applications. In general, failure rate should not exceed about 100 parts per million. For more critical uses such as military uses, failure rate should be less than about 50 parts per million, preferably less than about 10 parts per million and most preferably less than 5 parts per million. By failure of the projectile is meant that the projectile disintegrates prematurely, for example, upon firing or travel through a barrel or during trajectory, before striking a target, or does not disintegrate upon striking a target when intended to do so.

In evaluating failure rates, consideration should be given not only to stresses created during firing, trajectory and impact, but also deterioration of projectiles which might occur previous to firing and thus have an impact on firing and postfiring failure. Specifically, projectiles can be subjected to deterioration during storage and transport, and particularly the jarring and shocks associated with handling the projectiles, corrosion and other deterioration which accompanies exposure to humidity, corrosive environments, heat and cold, and stresses which might occur during loading of the projectile into the gun. Although the pre-firing stresses may not produce visible or detectable changes in the projectile, they may result in unobserved microscopic flaws which contribute to projectile structural failure upon or after firing. Failure rate is most realistically evaluated by considering the effect of such pre-firing stresses.

Second, traditional or conventional ceramic materials are very often characterized by an inverse relationship between susceptibility to thermal stress and susceptibility to mechanical stress. Moreover, conventional ceramics such as alumina, mullite, cordierite, porcelain, and so forth normally have insufficient strength and toughness to survive firing and flight environments particularly in relation to high velocity guns.

Third, in order to provide a projectile which mimics the aerodynamic and trajectory characteristics of the corresponding metallic projectile, as well as mimicking the handling, feeding, and loading characteristics of the corresponding metallic projectile, it is desired to use a material, preferably partially-stabilized zirconia, which has a density similar to the density of metallic projectiles, preferably on the order of about 5 grams/cc or more.

Fourth, because the response of a material to stress, abrasion and the like can be characterized by a large number of properties or measurements, including properties such as hardness, flexural strength at a variety of temperatures, coefficients of thermal expansion and conductivity, shear, bulk, and Young's moduli, Poisson's ratio, stress intensity factor, tensile strength, compressive strength, Weibull modulus, and so forth, it is no straightforward matter to select a material which will provide the characteristics desired for a projectile considering the above three factors. This is particularly true since many of the values for physical parameters are not known or readily available for the conditions to which a bullet will be subjected, such as high loading rates and accelerations, high temperatures and high pressures.

Fifth, because a bullet and a cartridge containing a bullet are subjected to a large range of temperatures, the ceramic should not have thermal expansion characteristics which are so different from those of the material from which the cartridge or other components, e.g. a driving band for engaging the bore of the gun, are made (typically metals) that the fit between the ceramic and other components becomes either too tight or too loose in response to changes in temperature.

SUMMARY OF THE INVENTION

According the present invention, a projectile is provided which is made of a densified, strong, tough ceramic material having a size and shape wherein it can be fired from a gun capable of firing a conventional metallic projectile. According to one embodiment, the ceramic comprises zirconia. According to another embodiment, the ceramic material has a tensile strength greater than about 250 MPa, a critical stress intensity factor greater than about 6 $MPam^{\frac{1}{2}}$, and a Weibull modulus greater than about 10. The present invention also includes a cartridge comprising a ceramic projectile and a method of making a cartridge. Particularly preferred is a frangible ceramic projectile for use in practice or target munitions.

According to the present invention, it has been found that a strong, tough, densified ceramic projectile can be provided which will accomplish the objects of the invention, namely producing a munitions projectile, particularly a frangible target or practice projectile which has (1) an acceptable probability of surviving firing and trajectory and an acceptable probability of disintegration upon impact, (2) little or no adverse environmental effect, (3) high resistance to corrosion such as during storage or transport, (4) nonsusceptibility to ablation or erosion, (5) surface characteristics which permit the projectile to mimic aerodynamics of metallic projectiles, and/or (6) a density similar to metallic densities which enables the ceramic projectile to simulate the flight properties of a live round of the same caliber. It has been found that a ceramic material will accomplish the objects of this invention when the material is within a desired range of tensile strength, stress intensity factor, and Weibull modulus. Zirconia ceramics, especially partially stabilized zirconia ceramics, have been found to be suitable. By "densified" is meant that the ceramic material has a density approaching theoretical, preferably greater than about 90 percent of theoretical density, such as that typically accomplished by sintering, hot-pressing, hot isostatic pressing, reaction sintering, or solidification from a melt. By "strong and tough" is meant that the projectile does not significantly disintegrate, ablate or vaporize prior to leaving the gun muzzle or striking a target or the ground. By "gun" is meant any apparatus for firing a projectile including hand guns, rifles, rifled or unrifled launchers, cannon, machine guns, and the like. The present invention is particularly useful for high velocity guns such as 20 mm aircraft machine guns or other larger or smaller caliber high velocity guns. By "frangible" is meant that the projectile disintegrates upon exiting the muzzle or striking a solid target or the ground, preferably forming particles which are less than about 5 grams in size.

In a preferred embodiment, the frangible projectile does not disintegrate until striking the ground or a target thereby remaining integral during trajectory. In a more preferred embodiment, this tensile strength is between about 350 MPa and about 840 MPa. If so desired, a ceramic projectile can be constructed so as to disintegrate upon leaving the gun muzzle. Preferably the tensile strength of such a disintegrating projectile is between about 250 MPa and about 350 MPa. By "ceramic" is meant any inorganic, nonmetallic material capable of being densified, e.g. zirconia, especially toughened or partially-stabilized zirconia, zirconia-alumina composites, and whisker-reinforced ceramics. Although the projectile comprises a ceramic, the ceramic part may be provided in conjunction with another material such as a metallic or plastic driving band. Such a driving band represents a small proportion of the projectile and does not create a significant ricochet problem or significantly interfere with frangibility.

DETAILED DESCRIPTION OF THE PREFERRED EMBODIMENT

Figure 1:
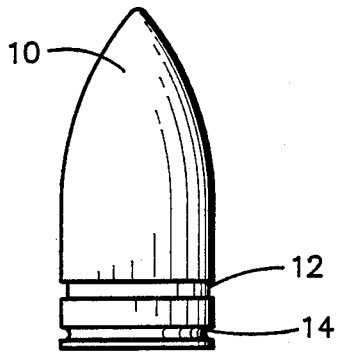
FIG. 1 is a side view of a ceramic projectile.
Figure 2:
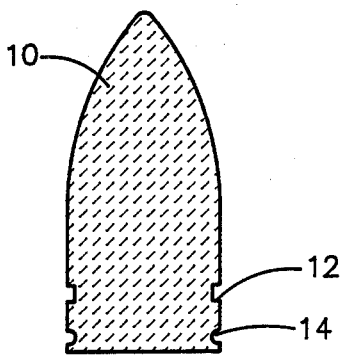
FIG. 2 is a cross-sectional side view of the projectile of FIG. 1.

The present invention relates to a ceramic projectile which survives firing and trajectory stresses, has little adverse environmental impact, is resistant to ablation and erosion, is resistant to corrosion and has surface characteristics and density similar to metallic projectiles. The projectile is formed of a ceramic material which can be incorporated into a cartridge for firing from a gun which is capable of firing a metallic projectile.

The ceramic material must have a sufficiently high strength, fracture toughness, and Weibull modulus that, for the stress environments for which it is designed, there is a high probability of surviving firing. When it is desired that the projectile disintegrate upon impact, the ceramic material must also be such that the projectile has a low probability of surviving impact. It has been found that an acceptable ceramic material should possess a tensile strength, according to, e.g. ACMA Test No. 4, of between about 250 MPa and about 840 MPa, preferably more than about 300 MPa, and most preferably more than about 350 MPa; a critical stress intensity factor, measured, e.g. according to the single-edge notched beam (SENB) Test (as described in Evans, A. G., "Fracture Mechanics Determinations" in *Fracture Mechanics of Ceramics*, Vol. 1, Ed. By R. C. Bradt, D. P. H. Hasselman and F. F. Lange, Plenum Press, NY, p. 17 (1974), incorporated herein by reference), of more than about 6 $MPam^{\frac{1}{2}}$, preferably more than about 8 $MPam^{\frac{1}{2}}$, most preferably more than about 12 $MPam^{\frac{1}{2}}$; and a Weibull modulus measured, e.g. as described in Weibull, W. "A Statistical Distribution Function of Wide Applicability", *J. Of Applied Mechanics*, Vol. 18, pp. 293-297, September 1951, incorporated herein by reference, of more than about 10, preferably more than about 14, and most preferably more than about 18.

The ceramic material can also have a coefficient of thermal expansion measured, e.g. according to ASTM C37256 of more than about $7.5\times10^{-6}/°C.$, preferably more than about $9\times10^{-6}/°C.$, and most preferably more than about $10\times10^{-6}/°C.$, and a Young's modulus (modulus of elasticity), measured by, e.g., ASTM C623-71, less than about 400 GPa, preferably less than about 300 GPa, and most preferably less than about 200 GPa.

A projectile with these characteristics will be operable for, e.g. the 20 millimeter projectile described above. Special applications, e.g. particularly low velocity guns, or extremely high velocity guns, can be used with ceramics having values for the above four parameters within a range adjusted mutatis mutandis, giving consideration to the above-described factors.

Examples of ceramic materials which can be used in producing the frangible projectile according to this invention include: zirconias, particularly partiallystabilized zirconias, such as magnesia-, calcia-, yttria-, or ceria-partially-stabilized zirconias.

Magnesia partially-stabilized zirconia materials are described in European Patent Application No. 80300025.6, Publication No. 0 013 599, filed Mar. 1, 1980 by Commonwealth Scientific and Industrial Research Organization, incorporated herein by reference. These include a ceramic material which comprises magnesia partially-stabilized zirconia having a magnesia content in the range from about 2.8 to about 4.0 weight percent. The zirconia powder from which the material is made contains no more than about 0.03 percent silica and the material has a microstructure comprising a matrix of grains of cubic stabilized zirconia. Each grain contains (a) discrete precipitates of tetragonal zirconia, each precipitate having an elliptical shape with the mean length in the long dimension being about 1500 Angstrom units and (b) discrete precipitates of microcrystalline monoclinic zirconia, produced by controlled thermal transformation of a proportion of the tetragonal zirconia precipitates. The material can be made by a method which comprises the steps of:

(a) mixing and wet-milling magnesium oxide powder and zirconium dioxide powder (which normally contains some hafnia, $HfO_2$) containing no more than about 0.03 percent by weight of silica, or materials capable of producing, on firing, magnesium oxide and zirconium oxide with no more than about 0.03 weight percent silica, in proportions such that the effective magnesium oxide content comprises from about 2.8 to about 4.0 weight percent of the mixture and the main particle size is about 0.7 micrometer;

(b) calcining the powders in the temperature range from about 800° C.) to about 1450° C. for about 24 hours;

(c) wet milling the calcined mixture until the main particle size is about 0.7 micrometer and the powder is reactive and sinterable;

(d) a fugitive binder amounting to about 4 weight percent of the dry powder mix is added and the mixture spray dried to form a powder which is molded into a desired shape using standard techniques such as cold pressing, isostatic pressing, slip casting or extrusion;

(e) firing the molded mixture at a temperature in the range from about 1500° C. to about 1800° C. for about 1 to 5 hours. A firing temperature of 1725° C. is preferred for a material containing 3.3 weight percent of magnesia;

(f) cooling the sintered material from the firing temperature to a nucleated temperature in the range between 800° C. and room temperature. A typical cooling rate is from 1700° C. to 1100° C. in about 2 hours, i.e. an average rate of about 300° C. per hour;

(g) heating the material immediately after nucleation to an aging/transformation temperature in a range from 1000° C. to about 1400° C. (alternatively, the nucleated material may be furnace cooled prior to heating to the aging/transformation temperature);

(h) holding the material at the aging/transformation temperature for a time sufficient for from 2–30 percent of the tetragonal zirconia precipitates to transform into monoclinic zirconia materials; and (i) furnace cooling the material to room temperature.

Calcia partially-stabilized zirconia having from about 2 to about 5 weight percent CaO can be used. It is preferred that ceramic materials containing between about 3.3 and about 4.7 weight percent calcia as disclosed in U.S. Pat. No. 4,067,745 issued Jan. 10, 1978 to Garvie, et al., entitled "Ceramic Materials", incorporated herein by reference, be used. These materials can be formed by firing a zirconia body containing between 3.3 and 4.7 percent by weight of calcia at a temperature between 1700° C. and 1950° C. and allowing the body to cool at an average rate of at least 175° C. per hour until the temperature is within the range of 1200° C. to 1400° C. and aging the body at a temperature in the range of 1200° C. to 1400° C. for a time such that peak strength is obtained. A preferred method disclosed in this patent includes:

(a) preparing a batch of material consisting of, on an analytical oxide basis, zirconia and calcia so that the calcia on firing comprises from 3.3 to 4.7 percent by weight of the product;

(b) molding the material by any suitable technique such as dry pressing, isostatic pressing, slip casting and the like and for this purpose a binder is generally used such as polyethylene glycol wax;

(c) heating the body to the firing temperature in the range of 1700° C. to 1950° C. for a period of about 3 to 5 hours, about 1800° C. for 3 hours being the preferred condition for 4 weight percent CaO;

(d) allowing the body to cool at an average temperature in the range between 175° C. and about 600° C. per hour, typically about 525° C. per hour to an aging temperature in the range 1200° C. to 1350° C., preferably about 1300° C.; and (e) allowing the body to cool to ambient temperature. The aging time is typically about 64 hours for the preferred conditions and compositions.

Other useful materials include magnesia partially-stabilized zirconia ceramics containing metal oxide additives. Such materials are disclosed in PCT Application No. PCT/AU83/00069, International Publication No. WO 83/04247, filed May 27, 1983 by Commonwealth Scientific and Industrial Research Organization, entitled "Zirconia Ceramic Materials and Method of Making Same", incorporated herein by reference. A magnesia partially-stabilized zirconia material is disclosed in which the cubic phase zirconia content of the material is in the range of from 70 percent by volume to 25 percent by volume of the ceramic material. The magnesia content of the material is in the range from 3 percent by weight to 3.65 percent by weight. The material contains an additive which is a metal oxide, preferably strontia or baria or a rare earth metal oxide or mixture thereof, which forms an insoluble zirconate that does not combine with magnesia, the metal oxide being present in the range from 0.05 percent by weight to 1.00 percent by weight. The microstructure of the material comprises grains of cubic stabilized zirconia, each grain containing precipitants of tetragonal zirconia which is transformable on the application of a tensile stress or upon heat treatment to monoclinic zirconia.

This material can be made by a process comprising mixing and wet milling a mixture of zirconium dioxide powder, magnesium oxide powder and the additive oxide powder containing no more than 0.5 percent by weight of silica, or materials capable of producing, on firing, zirconium dioxide, magnesium oxide and an additive oxide which is a metal oxide which forms an insoluble zirconate which does not combine with magnesia, in proportions such that the effective magnesium oxide content comprises from 3.0 weight percent to 3.65 weight percent of the mixture and the additive oxide content of the mixture is in the range from 0.05 weight percent to 1.00 weight percent. The mixture is molded into a desired shape and fired at a temperature in the range from about 1550° C. to about 1900° C. The fired molded mixture is cooled from the firing temperature to about 1400° C. at a rate which avoids cracking of the molded article, but is sufficiently rapid that if this cooling rate should be maintained until the material reaches room temperature, precipitates of tetragonal zirconia that are formed in the grain matrix would remain in the tetragonal phase. The fired material is then cooled from about 1400° C. to about 1000° C. at a rate which enables lenticular tetragonal precipitates to grow (on average) to about 150 nm in their longest dimension. The material is then allowed to cool to room temperature at a cooling rate which does not result in cracking of the product. The cooling step can be varied by interrupting the cooling rate and holding the molded material at the temperature of interruption for a predetermined period. Preferably such an isothermal hold is effected at about 1350° C. and again at about 1100° C.

Yttrium partially-stabilized zirconia ceramics can also be used. As disclosed in Canadian Patent No. 1,154,793 issued Nov. 4, 1983 to Otagiri, et al., entitled "Zirconia Ceramics and Method of Producing the Same", incorporated herein by reference, a yttrium compound can be combined with zirconium to produce a material containing a ratio of $Y_2O_3/ZrO_2$ of 2/98 7/93. Not more than 30 mol percent of the $Y_2O_3$ may be replaced by oxides of rare earth elements such as $Yb_2O_3$, $Sc_2O_3$, $Nb_2O_3$, and the like or CaO or MgO. The mixture is molded into an article and fired in air at a temperature within the range of 1000° C. to 1500° C., preferably within the range of 1100° C. to 1450° C., in which the highest temperature is maintained for 1 to 20 hours.

Other examples of ceramic materials include zirconia-toughened alumina (alumina/zirconia composites) such as 95 weight percent $Al_2O_3$-5 weight percent $ZrO_2$ to 10 weight percent $Al_2O_3$-90 weight percent $ZrO_2$, the $ZrO_2$ fraction containing 0 to 6 weight percent $Y_2O_3$; and SiC whisker-reinforced ceramics (e.g. alumina or mullite).

It has been found that magnesia partially-stabilized zirconia is less susceptible to flawing from stresses typically incurred during shipping and handling than, e.g., yttria partially-stabilized zirconia. Magnesia partially-stabilized zirconia has increased Weibull modulus as well as increased critical stress intensity values ($K_{Ic}$) for 100–200 micron scale flaw sizes, compared with yttria partially stabilized zirconia, even though yttria partially stabilized zirconia is often superior for smaller flaw sizes. Thus, a magnesia partially-stabilized zirconia is preferred for preparing the instant projectiles An example of such a material is transformation toughened zirconia (TTZ) produced by Coors Ceramics, containing about 3.0 weight percent magnesia and having a tensile strength at 25° C. (ALMA Test #4) of about 352 MPa, a stress intensity factor (single edged notched beam) of about 8–12 $MPam^{\frac{1}{2}}$ and a Weibull modulus (4 point bend) of about 20.

Partially-stabilized zirconias are particularly useful when very low structural failure rates for the projectiles are required, such as on the order of less than a few parts per million. It has been found that the preferred zirconia materials may have a lower average strength than less preferred materials when analyzed at a high (e.g. 50 percent) failure rate level, but that these same preferred materials will out-perform (i.e. will provide a better average strength) the non-preferred materials when analyzed at a lower level of failure rate, such as 5 to 100 parts per million or less.

Operable methods of manufacture of the ceramic are described in the above-cited patents although other processing methods may also be operable and may be preferred when special characteristics are desired or in order to achieve economy of manufacture.

Among the materials and methods which are operable for purposes of the present invention, the materials and methods which are preferred, of course, depend upon the intended application and factors such as material availability and cost of manufacture. When it is desired to maximize tensile strength, stress intensity factor, and Weibull modulus for a frangible ceramic projectile, the material described in European Patent No. 0 013 599 is preferred, i.e. a magnesia-partially-stabilized zirconia ceramic material having a magnesia content of about 2.8 to about 4.0 weight percent prepared from a zirconia powder containing less than about 0.03 weight percent silica. It has been found that zirconia powder having a silica content of up to about 0.2 weight percent can be employed without producing significant property differences.

In a preferred method of preparing the instant densified ceramic projectile, sufficient magnesium oxide or a material capable of forming magnesium oxide, such as magnesium carbonate, is combined with the zirconium dioxide powder to provide an effective magnesium oxide level in the ceramic of about 2.6 to 3.8 weight percent. These mixed powders are preferably calcined between about 1000° C. and about 1700° C., more preferably between about 1000° C. and 1500° C., for between about 4 and about 12 hours, preferably about 6 to about 10 hours. The resulting calcined mixture is wet milled until the average particle size is preferably between about 0.8 and 2.5 micrometers, more preferably about 1.5 micrometers. If needed, a sufficient amount of fugitive organic binder is added to allow formation of a compact green body having sufficient strength to allow machining to the desired shape. The amount needed depends on the method of formation and the particular binder used. Materials commonly used as binders in ceramics include resins such as poly(vinyl butyral), poly(ethylene glycol), poly(ethylene oxide), poly(vinyl alcohol), methyl cellulose, vinyl acetate latex, parafinic hydrocarbons, poly(N, N'-ethylene-Bis-Stearamide), as well as polymeric quinoline, potato starch and aqueous acrylic emulsions. Preferred binders include poly(ethylene glycol) resins of molecular weight from about 7,000 to about 20,000 and poly(ethylene oxide) resins of molecular weight from about 10,000 to about 300,000. Mixtures of binders can advantageously be used, for example, formulations consisting of poly(ethylene glycol) resins of molecular weight between about 7,000 about 9,000, poly(ethylene glycol) resins of molecular weight between about 15,000 and about 20,000, and poly(ethylene oxide) in weight percents of about 0–100, 100–0, and 0–50, respectively. Ordinarily the level of binder is between about 0.1 and about 7 weight percent of the calcined mixture with a preferred level being about 1.5 to about 2.0 weight percent. The mixture is then dried by evaporation of the water or preferably by spray drying. The dried powder is then formed into a compact of the desired shape by dry pressing, slip casting, injection molding, extrusion, or preferably by isostatically pressing the powder at a pressure above about 2,000 psi (13789.6 kPa), preferably above about 20,000 psi (137896 kpa). The compact can then be mechanically formed to the desired shape. The formed compact is then heated from ambient temperature at a rate of between about 25° C. per hour and about 250° C. per hour, preferably about 100° C. per hour, to a soak temperature of between about 1675° C. and about 1800° C., preferably between about 1700° C. and 1750° C. This soak temperature is held for between about 1 and about 10 hours, preferably about 2 to 6 hours. The sintered article is then cooled using a cooling procedure such as described in Robert R. Hughan, "Precipitation During Controlled Cooling of Magnesia-Partially-Stabilized Zirconia", J. Am. Ceram. Soc. 69, 556–563 (1986), incorporated herein by reference. A preferred procedure involves cooling the sintered body at a rate between about 250° C. and 800° C. per hour, preferably about 350° C. to about 500° C., to a temperature between about 800° C. and about 1400° C., preferably between about 800° C. and about 1000° C. The sintered article can then be furnace cooled to room temperature and mechanically surface finished as necessary to the desired configuration.

When manufacture cost is a larger consideration, a powder containing a somewhat higher degree of impurities such as silica, alumina or other impurities can be used, although in significant concentrations these impurities can cause undesired loss of properties. As indicated hereinabove, a silica content in the zirconia powder of up to about 0.2 weight percent can be used without significant property change. However, with zirconia containing more than about 0.5 weight percent silica, it is often necessary to make adjustments in processing, such as addition of materials such as strontia, as described in PCT/AU83/00069 hereinabove and in J. Drennan, "Effect of SrO Additions on the Grain-Boundary Microstructure and Mechanical Properties of Magnesia Partially-Stabilized Zirconia", J. Am. Ceram. Soc. 69, 541–546 (1986), incorporated herein by reference.

A number of post-sintering treatment regimes have been described in the above-cited references including isothermal holds at various temperatures during cooling, post-cooling annealing or "aging", such as described by Hannick, et al., "Magnesia Partially-Stabilized Zirconia: The Influence of Heat Treatment on Thermal Mechanical Properties", Australian Ceramic Society, Vol. 18, No. 2, pp. 53–62, 1982, incorporated herein by reference. It is preferred, for economic reasons to avoid post-cooling annealing or aging steps, provided the desired mechanical properties are obtained using the particular starting materials. Acceptable properties for the instant invention can be obtained without such aging steps with magnesia partially-stabilized zirconia. It is unknown, at this time, if there is any relation between the starting materials and the effect of annealing or aging steps.

Figure 3:
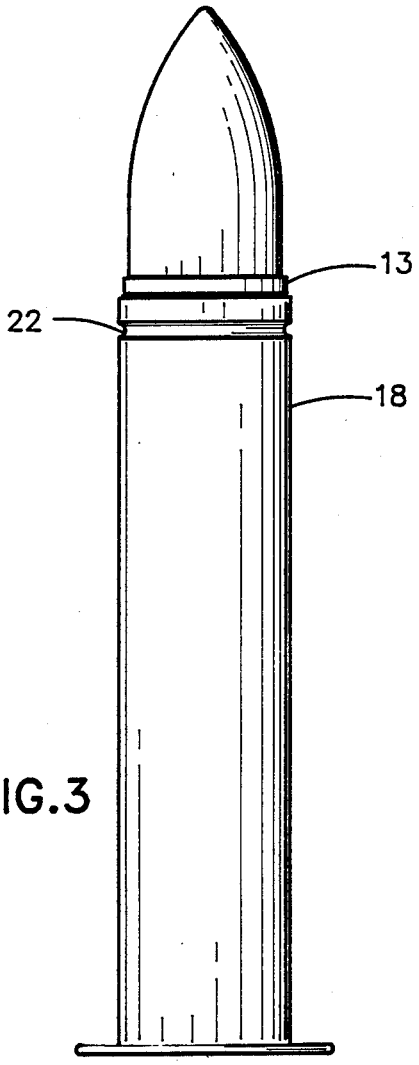
FIG. 3 is a side view of a cartridge containing a ceramic projectile.
Figure 4:
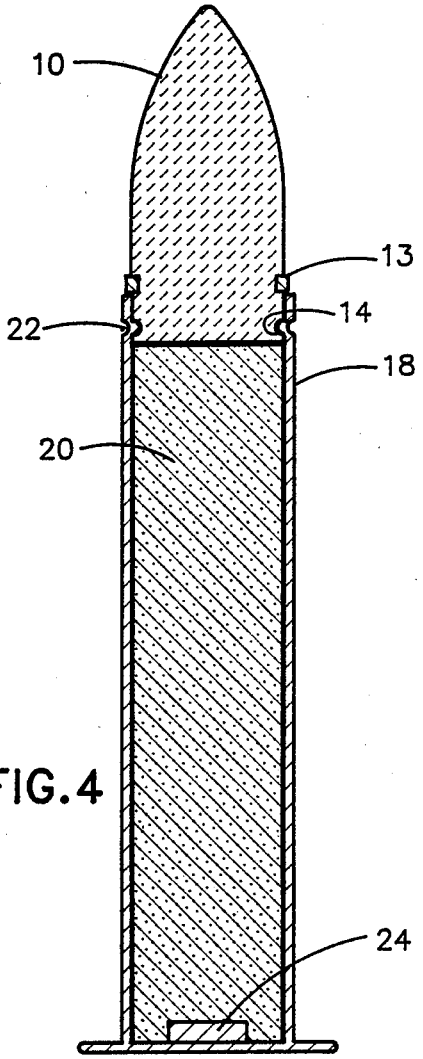
FIG. 4 is a cross-sectional side view of the cartridge of FIG. 3.

Referring now to the drawings, FIG. 1 depicts a densified ceramic projectile 10 which is used to form a cartridge or shell in the same manner that the replaced metallic projectile would be used. Since the leading edge or surface of the projectile is formed of ceramic and will be exposed to frictive contact with the air or other medium during trajectory, the ceramic projectile is treated, such as by machining, to produce a surface sufficiently smooth that the projectile aerodynamics will mimic the aerodynamics of the replaced metallic projectile. Typically a means such as indentation 12 is provided for allowing attachment of a driving band 13 for engaging the rifling of the gun barrel. As shown in FIGS. 3 and 4, the sintered ceramic projectile is attached, normally by crimping 22, for example, into indentation 14, to the opened end of a casing 18, containing a propellant 20 and a primer 24. The completed cartridge or shell can then be loaded into a gun adapted for use with the particular type of cartridge or shell and can be fired to propel the projectile from the gun.

As will be known to those skilled in the art, a number of modifications or variations on the preferred embodiment described above can be made. The ceramic projectiles can be formed of a number of ceramics. For example, the projectile can be made of a ceramic material which is sufficiently strong and tough that it is not frangible, i.e. such that it does not disintegrate before or upon striking a target. In this regard, ceramic projectiles are not necessarily restricted to practice or target use, but can be used for the ordinary purpose of munitions projectiles. Although it is expected that metallic projectiles would be preferred for economic reasons, ceramics may provide other benefits in special applications, such as propelling projectiles at a velocity high enough to cause ablation or vaporization of ordinary metals, e.g. with a rail gun. Alternatively, the ceramic can be such that the projectile retains its integrity while traveling through the gun barrel or launcher, but disintegrates upon exiting the muzzle or upon striking the ground or a target. Ceramic projectiles can be used in connection with a variety of guns including handguns, shotguns, rifles, mortar, cannon, tanks, machine guns, rail guns, and launched or missile projectiles. The ceramic projectiles can have incorporated therein various strengthening or toughening materials such as fibers or whiskers. The ceramic can be formed by hot-pressing, hot isostatic pressing, reaction sintering, solidification from a melt, such as single crystal solidification, or other methods known in the ceramic art. The precise ceramic materials will, of course, depend upon the intended application. In this regard, tougher, more strengthened materials are useful for high velocity guns while ceramic materials having a lower degree of strength and toughness can be used in lower velocity guns. The projectile can be provided with a location device or material such as a tracer or an impact-activated pyrotechnic or smoke generator.

The following example is intended by way of illustration and not by way of limitation.

EXAMPLE

A densified ceramic projectile was prepared using zirconium dioxide powder reported to contain 99% zirconium dioxide plus hafnium dioxide in which the hafnium dioxide accounted for approximately 2 weight percent of the total, about 0.2 weight percent $SiO_2$ about 0.15 weight percent $TiO_2$, about 0.02 weight $Fe_2O_3$, and about 0.25 weight percent $SO_3$. The material was also reported to have about 0.30 weight percent loss on ignition at 1400° C., a tamped bulk density of 2.4 g/cm$^3$, an average particle size of 14 microns, and a specific surface area of between 2 and 4 m$^2$g. The zirconium dioxide powder was mixed with reagent grade magnesium carbonate in proportions such that the effective magnesium oxide content upon firing comprised 3.0 weight percent of the mixture. The mixed powders were calcined at about 1440° C. for about 8 hours. The calcined mixture as wet milled to provide an average particle size of about 1.5 micrometer. An organic binder was added to the wet milled slurry in an amount of approximately 1.7 weight percent based upon the dry calcined mixture. The binder consisted of a mixture of poly(ethylene glycol) resin of molecular weight between about 7,000 and about 9,000, poly(ethylene glycol) resin of molecular weight between about 15,000 and about 20,000, and poly(ethylene oxide) of molecular weight of between about 10,000 and 300,000 in a weight ratio of about to 1.5 to 1.75, respectively. The resulting slurry was spray dried to form a powder. The resulting powder was isostatically pressed at about 20 kpsi to form a compact having roughly the desired shape. The compact was then formed on a lathe to the desired projectile shape. The formed compact was fired by heating from ambient temperature at a rate of about 100° C. per hour to about 1720° C. This temperature was maintained for approximately 4 hours after which the sintered article was cooled at an average rate of about 400° C. per hour to 1000° C. The sintered article was then furnace cooled to room temperature. The sintered article was then finished to the desired configuration by diamond grinding. The projectile was found to be frangible when impacted against a target surface.

Although the preferred embodiment has been described by way of illustration and example, as known to those skilled in the art, a number of variations and modifications of the invention can be practiced within the scope of the present invention as limited only by the appended claims.

What is claimed is:

1. A tough, densified munitions projectile comprising a ceramic having a tensile strength greater than about 250 MPa, a critical stress intensity factor greater than about 6 MPam$^{1/2}$, and a Weibull modulus greater than about 10, said ceramic comprising material selected from the group consisting of zirconia, zirconia-toughened alumina, and SiC whisker-reinforced alumina.

2. The projectile of claim 1 wherein said projectile is frangible.

3. The projectile of claim 1 wherein said ceramic has a tensile strength less than about 840 MPa.

4. The projectile of claim 1 wherein said ceramic comprises partially-stabilized zirconia.

5. The projectile of claim 4 having a density of at least 5.5 g/cc.

6. The projectile of claim 1 wherein said tensile strength is between about 250 MPa and about 840 MPa.

7. The projectile of claim 1 wherein said tensile strength is between about 300 MPa and about 840 MPa.

8. The projectile of claim 1 wherein said Weibull modulus is greater than about 14.

9. The projectile of claim 1 wherein said critical stress intensity factor is more than about 8 MPam$^{1/2}$.

10. The projectile of claim 1 having a driving band located around said projectile to engage a bore of said gun upon firing the projectile from the gun.

11. The frangible, tough, densified ceramic munitions projectile comprising partially-stabilized zirconia having a tensile strength greater than about 350 MPa, a critical stress intensity factor greater than about 12 MPam$^{1/2}$, and a Weibull modulus greater than about 18.

12. A cartridge for firing from a gun comprising:

a casing having an opened end;

a strong, tough, densified ceramic projectile comprising material selected from the group consisting of zirconia, zirconia-toughened alumina, and SiC whisker-reinforced alumina, having sufficient strength and toughness to remain integral during firing and travel through a barrel said projectile comprising a ceramic material having a tensile strength greater than about 250 MPa, a critical stress intensity factor greater than about 6 MPam$^{1/2}$, and a Weibull modulus greater than about 10, a portion of said projectile disposed within said opened end of said casing; and propellant in said casing for firing said projectile from a gun.

13. A cartridge according to claim 12 wherein said ceramic projectile has sufficient frangibility to fracture upon striking a solid target.

14. A tough, densified munitions projectile comprising a ceramic having a tensile strength greater than about 250 MPa, a critical stress intensity factor greater than about 6 MPam$^{1/2}$, a Weibull modulus greater than about 10, and a modulus of elasticity less than about 400 GPa.

* * * * *

UNITED STATES PATENT AND TRADEMARK OFFICE

CERTIFICATE OF CORRECTION

PATENT NO. : 4,939,996

DATED : July 10, 1990

INVENTOR(S) : Dinkha et al.

It is certified that error appears in the above-identified patent and that said Letters Patent is hereby corrected as shown below:

Column 7, lines 13 and 14, delete "partiallystabilized" and insert therefor --partially-stabilized--.

Column 7, line 47, delete "C.)" and insert therefor --C.--.

Column 13, line 21, after "about" insert --1--.

Column 14, line 20, delete "The" and insert therefor --A--.

Signed and Sealed this

Seventeenth Day of September, 1991

*Attest:*

HARRY F. MANBECK, JR.

*Attesting Officer*

*Commissioner of Patents and Trademarks*